US010407831B2

(12) United States Patent
Hietaniemi et al.

(10) Patent No.: US 10,407,831 B2
(45) Date of Patent: Sep. 10, 2019

(54) SIZING COMPOSITION, ITS USE AND A METHOD FOR PRODUCING PAPER, BOARD OR THE LIKE

(71) Applicant: Kemira Oyj, Helsinki (FI)

(72) Inventors: Matti Hietaniemi, Espoo (FI); Jan-Luiken Hemmes, Bergisch Gladbach (DE); Vladimir Grigoriev, Cologne (DE); Asko Karppi, Turku (FI)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 15/508,961

(22) PCT Filed: Sep. 4, 2015

(86) PCT No.: PCT/FI2015/050582
§ 371 (c)(1),
(2) Date: Mar. 6, 2017

(87) PCT Pub. No.: WO2016/034776
PCT Pub. Date: Mar. 10, 2016

(65) Prior Publication Data

US 2017/0284028 A1 Oct. 5, 2017

(30) Foreign Application Priority Data

Sep. 4, 2014 (FI) ..... 20145769
Dec. 12, 2014 (FI) ..... 20146086

(51) Int. Cl.

| | |
|---|---|
| ***D21H 21/16*** | (2006.01) |
| ***D21H 17/37*** | (2006.01) |
| ***D21H 11/14*** | (2006.01) |
| ***D21H 17/28*** | (2006.01) |
| ***D21H 17/29*** | (2006.01) |
| ***D21H 19/54*** | (2006.01) |
| ***D21H 21/18*** | (2006.01) |
| ***D21H 23/04*** | (2006.01) |
| ***D21H 23/22*** | (2006.01) |

(52) U.S. Cl.
CPC ..... *D21H 21/16* (2013.01); *D21H 11/14* (2013.01); *D21H 17/28* (2013.01); *D21H 17/29* (2013.01); *D21H 17/37* (2013.01); *D21H 17/375* (2013.01); *D21H 19/54* (2013.01); *D21H 21/18* (2013.01); *D21H 23/04* (2013.01); *D21H 23/22* (2013.01)

(58) Field of Classification Search
CPC ..... D21H 21/16
See application file for complete search history.

(56) References Cited

U.S. PATENT DOCUMENTS 4,066,495 A 1/1978 Voigt et al.
4,181,567 A * 1/1980 Riddell ..... D21H 17/00 162/168.3
4,784,724 A 11/1988 Pfohl et al.
5,084,347 A 1/1992 Kuhnhauser-Buch et al.
5,438,087 A * 8/1995 Ikeda ..... C08L 93/04 524/272
5,750,253 A * 5/1998 Satake ..... D21H 19/20 162/164.7
5,824,190 A 10/1998 Guerro et al.
6,034,181 A 3/2000 Bazaj et al.
6,281,291 B1 * 8/2001 Bazaj ..... B41M 5/5254 162/166
6,331,229 B1 * 12/2001 Wong Shing ..... D21H 21/10 162/164.6
6,494,990 B2 * 12/2002 Bazaj ..... B41M 5/5254 162/166
2001/0051687 A1 12/2001 Bazaj et al.
2003/0040568 A1 * 2/2003 Furuta ..... D21H 17/72 524/520
2003/0102097 A1 6/2003 Moffet
2003/0188840 A1 10/2003 Van Handel et al.
2004/0171719 A1 * 9/2004 Neivandt ..... C08L 3/00 524/47

(Continued)

FOREIGN PATENT DOCUMENTS

JP H07109692 A 4/1995
JP H11241295 A 9/1999

(Continued)

OTHER PUBLICATIONS

Van den Einde et al. (Carbohydrate Polymers 56 (2004) 415-422) (Year: 2004).*
Finnish Patent and Registration Office, Search report FI20145769, dated Apr. 9, 2015.
Finnish Patent and Registration Office, Search report FI20146086, dated Aug. 6, 2015.
Russian Patent Office, Russian Search Report, dated Aug. 31, 2018.
Chinese Patent Office, Office Action of CN201580047681.X, dated Jan. 17, 2018.

*Primary Examiner* — Liam J Heincer
(74) *Attorney, Agent, or Firm* — Berggren LLP

(57) ABSTRACT

The invention relates to a composition for sizing of a surface of paper, board or the like and its use for increasing strength properties of paper, board or the like. The composition has a solids content of 3-30%, and it comprises degraded non-ionic starch, and at least 0.5 weight-% of anionic polyacrylamide, which has a molecular weight, MW, >500 000 g/mol and <2 500 000 g/mol and an anionicity in the range of 4-35 mol-%. The invention further relates also to a method for producing paper, board or the like, which comprises addition of a first strength composition, which comprises a cationic agent, to a fiber stock, formation of a fibrous web from the fiber stock, drying of the fibrous web to dryness of at least 60%, and application of a second strength composition, which comprises an anionic hydrophilic polymer and a starch component, on the surface of the fibrous web.

23 Claims, No Drawings

(56) References Cited

U.S. PATENT DOCUMENTS

| | | | | |
|---|---|---|---|---|
| 2005/0155731 | A1 | 7/2005 | Martin et al. | |
| 2006/0008496 | A1* | 1/2006 | Kulkarni | A01N 25/34 424/412 |
| 2006/0060814 | A1 | 3/2006 | Pawlowska et al. | |
| 2011/0112224 | A1 | 5/2011 | Borkar et al. | |
| 2011/0147306 | A1* | 6/2011 | Polizzotti | B01D 21/262 210/638 |
| 2013/0299109 | A1 | 11/2013 | Hietaniemi et al. | |
| 2014/0110073 | A1* | 4/2014 | Karppi | D21H 17/72 162/164.3 |
| 2015/0041092 | A1 | 2/2015 | Hietaniemi et al. | |
| 2016/0289896 | A1 | 10/2016 | Hietaniemi et al. | |

FOREIGN PATENT DOCUMENTS

| | | | |
|---|---|---|---|
| JP | 2011214190 | A | 10/2011 |
| RU | 2130101 | C1 | 5/1999 |
| WO | 2005012639 | A1 | 2/2005 |
| WO | 2012042115 | A1 | 4/2012 |

* cited by examiner

SIZING COMPOSITION, ITS USE AND A METHOD FOR PRODUCING PAPER, BOARD OR THE LIKE

PRIORITY

This application is a U.S national application of PCT-application PCT/FI2015/050582 filed on Sep. 4, 2015 and claiming priority of Finnish national applications 20145769 filed on Sep. 4, 2014 and FI20146086 filed on Dec. 12, 2014, the contents of all of which are incorporated herein by reference.

The present invention relates to a composition for sizing of a surface of paper, board or the like, and to the use of the composition according to the preambles of enclosed claims. Further, the present invention relates to a method for producing paper, board or the like.

One major object in the manufacture of low grades of paper and board is the cost efficiency. This object may be achieved by applying various different measures, e.g. by reducing the basis weight of produced paper or board, by increasing the filler content, by using cheap raw materials, e.g. recycled fibres, and/or by developing production output. However, many of these measures may have a negative impact on the properties of the obtained paper or board product, especially on the strength properties. These drawbacks are counteracted by using different chemicals in paper or board making. For example, strength properties of produced paper or board may be improved by internal sizing and/or by surface sizing of the produced paper or board. In internal sizing a solution of a synthetic polymer or starch is added to the paper stock in order to improve especially the internal strength properties of the formed web. In surface sizing a solution of modified starch or a synthetic polymer is applied on the surface of the formed, at least partially dried fibrous web, whereby the surface strength of the web is improved.

Compression strength and burst strength are important strength properties for paper and board, especially for grades used for packaging. Compression strength is often measured and given as Short-span Compression Test (SCT) strength, which may be used to predict the compression resistance of the final product, e.g. cardboard box. Burst strength indicates paper's/board's resistance to rupturing, and it is defined as the hydrostatic pressure needed to burst a sample when the pressure is applied uniformly across the side of the sample. Both the compression strength and burst strength are negatively affected when the amount of inorganic mineral fillers and/or recycled fibres in the original stock is increased.

It has been observed that the compression strength and burst strength can be improved by surface sizing. However, the problem has been that only one of these strength properties has been improved to an acceptable level, while another has remained on an inferior level. For practical applications, especially for products used in packaging, the produced paper and board should have at least acceptable or good compression strength as well as acceptable or good burst strength. Consequently, there is a need for new ways to improve both of these properties at the same time.

Furthermore, it has been observed that the strength effects obtainable with various sizing chemicals and methods may become limited when the fibre stock has high conductivity, high cationic demand and/or high ash content. Especially stocks comprising mechanical pulp, recycled pulp and/or having high filler content are challenging for strength improvement by sizing. In paper and boardmaking the use of inexpensive fibre sources, such as old corrugated containerboard (OCC) or recycled paper, has been increasing over the past decades. OCC comprises mainly used recycled unbleached or bleached kraft pulp fibres, hardwood semi-chemical pulp fibres and/or grass pulp fibres. Likewise the use of mineral fillers has been increasing in paper and boardmaking. Consequently, also for this reason there is a constant need and search for new ways to increase the strength properties of the paper or board.

The use of strength improving chemicals for low grades of paper and/or board is generally limited for cost reasons. Even if suitable chemicals would exists, they cannot be used, if they are too expensive and negatively affect, i.e. increase, the final price of the product. Consequently, there is a continuing need for novel cost-effective alternatives for improving the strength properties of paper and board.

An object of this invention is to minimise or even eliminate the disadvantages existing in the prior art.

An object of the present invention is to provide a surface sizing composition for improving the strength properties, especially for simultaneously improving the burst strength and Short-span Compression Test (SCT) strength of paper, board or the like.

Another object of the present invention is to provide a surface sizing composition, which provides good sizing results in a cost effective manner.

Still another object of the present invention is to provide a simple and effective method for producing paper, board or the like with increased strength properties, such as burst strength, short span compression test (SCT) strength, Concora medium test (CMT) strength, tensile strength and internal bond strength.

These objects are attained with a method and an arrangement having the characteristics presented below in the characterising parts of the independent claims. Some preferred embodiments are describes in the dependent claims.

The embodiment examples and advantages mentioned in this text relate, as applicable, to the size composition, its use as well as to method for producing paper, board or the like, even if this is not always specifically stated.

Typical sizing composition according to the first aspect of the present invention for sizing of a surface of a paper, board or the like, has a solids content of 3-30 and comprises

- degraded non-ionic starch, and
- at least 0.5 weight-% of anionic polyacrylamide, which has a molecular weight, MW, >500 000 g/mol and <2 500 000 g/mol, and an anionicity in the range of 4-35 mol-%.

Typically the surface size composition according to the first aspect of the present invention is used for surface sizing to increase strength properties of paper, board or the like.

Typical method according to the second aspect of the present invention for producing paper, board or the like, comprises

- adding to a fibre stock a first strength composition, which comprises a cationic agent,
- forming a fibrous web from the fibre stock,
- drying the fibrous web to dryness of at least 60%,
- applying on the surface of the fibrous web a second strength composition, which comprises an anionic hydrophilic polymer.

According to the first aspect of the invention it has now been surprisingly found that a surface size composition comprising degraded non-ionic starch and anionic polyacrylamide with specific molecular weight and anionicity unexpectedly provides improvement of both the SCT strength and burst strength when it is added or applied on the surface of paper or board. Without wishing to be bound by a theory it is assumed that the sizing composition according to the present invention provides optimal bonding between the fibres in the paper/board stock and the constituents of the sizing composition, and this improves both the SCT strength as well as burst strength of the paper and board.

Furthermore, it has been observed that it may be possible to achieve improvements in one or several of the following strength properties of the paper and/or board, namely Concora Medium Test (CMT) strength, Ring Crush Test (RCT) strength and/or tensile strength, by using the sizing composition according to the present invention for treating or sizing the surface of the said paper or board web. In some cases improvements in surface strength (IGT) and Scott bond strength have been achieved for printing paper, when it has been surface sized by using the sizing composition according to the invention. It should be, however, noted that an improvement in all the above-listed strength properties (RCT, CMT, tensile strength) is not necessarily obtained simultaneously or in same degree.

Still further, it may be possible to improve, i.e. increase, the strength properties of the wet paper or board web by using the sizing composition according to the present invention. It has been observed that when the sizing composition according to the present invention is used for surface sizing, the sized web has higher dry solids content after the sizing than when a conventional surface sizing composition is used for surface sizing. High dry solids content provides higher tensile strength for the wet sized web even before drying.

According to one embodiment of the first aspect of the present invention the sizing composition comprises 0.5-10 weight-%, preferably 0.75-5 weight-%, preferably 1-2.5 weight-%, of anionic polyacrylamide. It was surprisingly observed that even these small amounts of anionic polyacrylamide provided positive strength results for the final sized paper or board. Also, the anionic polyacrylamide has positive effect on the viscosity of the sizing composition, i.e. increases the viscosity of the size composition. Furthermore, the anionic polyacrylamide has also positive effect on the size pick-up at the pond size press, i.e. reduces the pick-up, which consequently reduces the amount of surface sizing composition needed for surface sizing.

Anionic polyacrylamide of the sizing composition according to the first aspect is a linear or cross-linked copolymer of acrylamide and at least one anionic monomer, such as unsaturated carboxylic acid monomer. Preferably the anionic monomer is selected from unsaturated mono- or dicarboxylic acids, such as acrylic acid, methacrylic acid, maleic acid, itaconic acid, crotonic acid, isocrotonic acid, and any of their mixtures. Also other anionic monomers, such as vinylsulphonic acid, 2-acrylamide-2-methylpropanesulfonic acid, styrene sulfonic acid, vinyl phosphonic acid or ethylene glycol methacrylate phosphate, may be included. According to one preferable embodiment the anionic polyacrylamide is a copolymer of acrylamide and unsaturated carboxylic acid monomers, such as (meth) acrylic acid, maleic acid, crotonic acid, itaconic acid or their mixture. Preferably the anionic polyacrylamide is a copolymer of acrylamide and acrylic acid, or a copolymer of acrylamide and itaconic acid, or a copolymer of acrylamide and methacrylic acid. Especially, if high hydrophobic properties are required for the final paper/board product, methacrylic acid may be chosen as an anionic monomer. According to one embodiment the anionic polyacrylamide originates from >20 mol-% of non-ionic monomers and 4-35 mol-%, preferably 4-24 mol-%, more preferably 5-17 mol-%, of anionic monomers.

Anionic polyacrylamide may comprise, in addition to the acrylamide and anionic monomers, small amounts of other polymerisation additives, such as cross-linker monomers. An example of a suitable cross-linker monomer is methylene bisacrylamide. The amount of these polymerisation additives is, however, small, such as <0.1 mol-%, typically <0.05, more typically <0.025, sometimes even <0.01 mol-%.

According to one preferable embodiment of the invention the anionic polyacrylamide of the sizing composition according to the first aspect has anionicity in the range of 4-24 mol-%, preferably 4-17 mol-%, more preferably 5-17 mol-%, even more preferably 7-15 mol-% or 9-13 mol-%. When the anionicity of the polyacrylamide is within these ranges, a simultaneous improvement in SCT strength and burst strength of the produced paper or board was unexpectedly observed.

The anionic polyacrylamide of the sizing composition may be a dry polymer, with a dry solids content of 80-98 weight-%, a solution polymer with an active polymer concentration of 5-35 weight-%, an emulsion polymer with an active polymer concentration of 20-55 weight-%, or a dispersion polymer with an active polymer concentration of 10-40 weight-%. The dry polymer or emulsion polymer is dissolved to water in order to obtain 0.4-4 weight-% concentration of polymeric substance before use. The anionic polyacrylamide is preferably a dry polymer or a solution polymer.

According to one preferable embodiment of the first aspect of the present invention the anionic polyacrylamide used in the sizing composition has the average molecular weight in the range of 530 000-2 000 000 g/mol, preferably 530 000-1 500 000, more preferably 650 000-1 400 000 g/mol, even more preferably 650 000-1 200 000 g/mol.

In this application the value "average molecular weight" is used to describe the magnitude of the polymer chain length. Average molecular weight values are calculated from intrinsic viscosity results measured in a known manner in 1N NaCl at 25° C. by using an Ubbelohde capillary viscometer. The capillary selected is appropriate, and in the measurements of this application an Ubbelohde capillary viscometer with constant K=0.005228 was used. The average molecular weight is then calculated from intrinsic viscosity result in a known manner using Mark-Houwink equation $[\eta]=K\cdot M^{a}$, where $[\eta]$ is intrinsic viscosity, M molecular weight (g/mol), and K and a are parameters given in Polymer Handbook, Fourth Edition, Volume 2, Editors: J. Brandrup, E. H. Immergut and E. A. Grulke, John Wiley & Sons, Inc., USA, 1999, p. VII/11 for poly(acrylamide). Accordingly, value of parameter K is 0.0191 ml/g and value of parameter a is 0.71. The average molecular weight range given for the parameters in used conditions is 490 000-3 200 000 g/mol, but the same parameters are used to describe the magnitude of molecular weight also outside this range. For polymers having a low average molecular weight, typically around 1 000 000 g/mol or less, the average molecular weight may be measured by using Brookfield viscosity measurement at 10% polymer concentration at 23° C. temperature. Molecular weight [g/mol] is calculated from formula 1000 000*0.77*ln(viscosity[mPas]). In practice this means that for polymers which the Brookfield viscosity can be measured and the calculated value is less than <1 000 000 g/mol, the calculated value is the accepted MW value. If the Brookfield viscosity cannot be measured or the calculated value is over 1 000 000 g/mol, the MW values are determined by using intrinsic viscosity as described above.

The starch used in the sizing composition of the first aspect of the present invention is non-ionic degraded starch. The degradation method of the starch is preferably carefully selected so that the amount of ionised groups, which are introduced to the starch backbone during the degradation, is minimized or completely avoided. According to one preferred embodiment of the invention the starch is enzyme treated, i.e. enzymatically degraded, or thermally degraded. For example, the starch can be enzymatically degraded in-situ in the paper or board mill and mixed with the anionic polyacrylamide at a sizing station.

The starch, prior to possible degradation, may have an amylose content of 15-30%, preferably 20-30%, more preferably 24-30%. Starch may be corn, wheat, barley or tapioca starch, preferably native corn starch or native maize starch. It has been observed that the sizing results for paper and board, especially the various strength properties, which are obtained with the sizing compositions according to the present invention, are unexpectedly improved when anionic polyacrylamide is mixed with these starches.

According to one embodiment the sizing composition may comprise one or more sizing composition additives in amount of 0.1-4 weight-%, preferably 0.5-3 weight-%, more preferably 0.5-2 weight-%. The sizing composition additive may be a hydrophobisation agent, polymeric acrylate size, such as styrene acrylate copolymer, alkyl ketene dimer (AKD) and/or alkenyl succinic anhydride (ASA). According to one preferable embodiment of the first aspect the sizing composition is cationic.

According to one preferable embodiment of the all aspects of the invention the sizing composition is free from inorganic mineral fillers or pigments.

According to one embodiment of the first aspect of the present invention the sizing composition has a dry solids content of 5-20 weight-%, preferably 7-15 weight-%, calculated from the total weight of the composition.

It has been observed that at the use temperature the viscosity of the sizing composition is 1.1-10, typically 1.5-10, preferably 2.5-8, times higher than the viscosity of corresponding starch solution at the same dry solids content but without the anionic polyacrylamide component, measured with Brookfield SSA, Spindel 18, 60 rpm, 60° C. The viscosity of the corresponding starch solution may be 2-80 mPas, preferably 2-40 mPas, more preferably 2-20 mPas, at 10% concentration, measured with Brookfield SSA, Spindel 18, 60 rpm, 60° C. For example, a surface sizing composition according to the first aspect of the invention may have a viscosity of 18-20 mPas, whereas a starch solution at the same dry solids content has a viscosity of 3 mPas. The increased viscosity of the composition has a positive effect on the SCT strength and burst strength which are obtained. Furthermore, the increased viscosity of the sizing composition reduces the starch pick-up at the sizing, which provides further savings in material costs of the process.

According to the second aspect of the of the present invention it has been also surprisingly found that the strength properties of paper and board are increased and improved when a first strength composition comprising a cationic agent is added to the fibre stock and a second strength composition, i.e. sizing composition, comprising at least one anionic hydrophilic polymer is applied on the surface of the formed web. Without wishing to be bound by a theory, it is assumed that the cationic agent in the first strength composition interacts with the anionically charged sites on the surfaces of the fibres of the pulp. This improves the internal bonds and/or interactions between the fibres in the web and has a positive impact on strength of the paper or board web. When a second strength composition comprising at least one anionic polymer is applied on the surface of the web, the anionic polymer interacts with the cationic charges present in the web and thus further strengthens the bonding and/or interaction with the various constituents of the paper or board. The result which is observed, irrespective of the origin of the effect, is the increased strength, especially the short span compression test (SCT) strength and/or burst strength, of the formed paper or board web. Also other strength properties such as tensile strength and internal bond strength may be improved. A synergetic strength effect is thus achieved by the present invention, where a first strength composition with a cationic agent is added to the stock and a second strength composition comprising an anionic hydrophilic polymer is applied thereafter on the surface of the formed web.

The term "hydrophilic polymer" is understood in the present context as a polymer, which is fully soluble and miscible with water. When mixed with water, the hydrophilic polymer is fully dissolved and the obtained polymer solution is essentially free from discrete polymer particles and no phase separation can be observed. The term "hydrophilic" is considered in this context to be synonymous with the term "water-soluble".

According to one embodiment of the second aspect of the invention the first strength composition is added to the fibre stock and the second strength composition is added on the fibre web so that the ratio of the added cationic charges in first strength composition to the added anionic charges of the sizing strength composition is in the range between 0.1 to 30, preferably 0.15-25, more preferably 0.2-5, even more preferably 1.1-4. The charge ratio can thus be for example from 0.1, 0.2, 0.5, 0.75, 0.85, 1.0, 1.1, 1.2, 1.5, 2.0, 2.5, 3.0, 4.0, 4.5, 5 or 5.5 up to 3.5, 4, 4.5, 5, 7, 10, 12.5, 15, 17.5, 20, 22, 25 or 30. The added charge is calculated by multiplying the used dose amount of the component with the charge density of the component. This added charge value is calculated separately for both the first strength component and the second strength component, and the ratio of added charge values is then calculated.

The cationic agent in the first strength composition, which is added to the fibre stock according to the second aspect of the invention, may comprise cationic starch or at least one cationic synthetic polymer or a mixture of cationic starch and cationic synthetic polymer(s). The first strength composition may also comprise a plurality of cationic synthetic polymers and the first strength composition may be a mixture of synthetic cationic polymers. In the context of the present application it is understood that a cationic polymer may also contain local anionic charges as long as its net charge of the synthetic polymer is cationic.

When in the second aspect of the invention the cationic agent in the first strength composition comprises both cationic starch and at least one cationic synthetic polymer it is possible to mix the cationic starch and the cationic synthetic polymer together to form the first strength composition, which is consequently added to the fibre stock. Alternatively, cationic starch and the synthetic cationic polymer(s) may be added separately but simultaneously to the fibre stock. According to one embodiment of the invention the first strength composition comprises 10-99 weight-%, preferably 30-80 weight-% of starch and 1-90 weight-%, preferably 20-70 weight-% of cationic synthetic polymer(s). For example, a first strength composition comprising ≥30 weight-% of cationic starch is preferred for treating a fibre stock with filler content >15%.

According to one embodiment of the second aspect of the present invention the cationic synthetic polymer, which can be used as cationic agent in the first strength composition, is selected from a group comprising copolymers of (meth) acrylamide and cationic monomers; glyoxylated polyacrylamide; poly(vinylamine, N-vinylformamide); polyamidoamine epihalohydrin and any of their mixtures. The cationic synthetic polymer may be linear or cross-linked, preferably linear. Preferably the cationic synthetic polymer is hydrophilic polymer. According to one preferable embodiment the cationic synthetic polymer is a copolymer (meth)acrylamide and at least one cationic monomer. The cationic monomer may be selected from the group consisting methacryloyloxyethyltrimethyl ammonium chloride, acryloyloxyethyltrimethyl ammonium chloride, 3-(methacrylamido) propyltrimethyl ammonium chloride, 3-(acryloylamido) propyltrimethyl ammonium chloride, diallyldimethyl ammonium chloride, dimethylaminoethyl acrylate, dimethylaminoethyl methacrylate, dimethylaminopropylacrylamide, dimethylamino-propylmethacrylamide, or a similar monomer. According to one preferred embodiment of the second aspect of the invention the cationic agent of the first strength composition is a copolymer of acrylamide or methacrylamide with (meth)acryloyloxyethyltrimethyl ammonium chloride. An acrylamide or methacrylamide based polymer may also be treated after the polymerisation to render it cationic, for example, by using Hofmann or Mannich reactions.

According to one embodiment of the second aspect of the present invention the cationic synthetic copolymer, which can be used as cationic agent in the first strength composition, is a copolymer originating from >20 mol-% non-ionic monomers and 3-30 mol-%, preferably 5-20 mol-%, more preferably 6-10 mol-% cationic monomers.

The cationic synthetic polymer, which can be used as cationic agent in the first strength composition, may also contain both cationic and anionic functional groups, as long as the net charge of the polymer is cationic. For example, the synthetic cationic polymer may be a copolymer of (meth) acrylamide and cationic monomers listed above as well anionic monomers, such as acrylic acid, as long as the net charge of the polymer remains cationic. The synthetic cationic polymer may be, for example, a copolymer of polyvinylamine and acrylic acid The charge density of the cationic agent of the first strength composition is preferably optimised so that the surface charges of the fibres in the stock remain anionic after addition of the first strength composition and before web formation, when the first strength composition is added in amount defined below. Surface charge of the fibres can be measured by using any suitable method, e.g. with Mütek SZP-06 tester. The cationic agent may have a charge density of 0.05-20 meq/g, preferably 0.05-5 meq/g, more preferably 0.1-3 meq/g, even more preferably 0.3-2 meq/g, even more preferably 0.5-1.4 meq/g at pH 7. Charge densities are measured by using Mütek PCD-03 tester, titrator PCD-T3. When the cationic agent comprises both cationic starch and at least one cationic synthetic polymer the charge density of cationic starch is typically lower than the charge density of the cationic synthetic polymer.

According to the second aspect of the invention when first strength composition comprises a cationic agent, which is a synthetic cationic polymer, the synthetic cationic polymer may have an average molecular weight MW of 200 000-6 000 000 g/mol, preferably 300 000-3 000 000 g/mol, more preferably 500 000-2 000 000 g/mol, even more preferably 600 000-950 000 g/mol. Molecular weight of the synthetic cationic polymers are measured by using known chromatographic methods, such as gel permeation chromatography employing size exclusion chromatographic columns with polyethylene oxide (PEO) calibration. If the molecular weight of the synthetic cationic polymer, measured by gel permeation chromatography exceeds 1 000 000 g/mol, the reported molecular weight is determined by measuring intrinsic viscosity by using Ubbelohde capillary viscometer as described earlier in this application. The average molecular weight of the synthetic cationic polymer is carefully optimised for improved performance especially in conditions of high cationic demand, i.e. >300 μeq/l, and/or high conductivity, i.e. >2.5 mS/cm. The average molecular weight of the synthetic cationic polymer is optimised in order to prevent its consumption by anionic trash particles instead of interaction with fibres, which may occur if the molecular weight is too low. Further, it has been observed that too high molecular weight may lead to extensive flocculation, poor formation and strength loss, e.g. burst strength and SCT strength loss.

According to one preferred embodiment of the second aspect of the present invention the cationic agent of the first strength composition comprises a synthetic cationic polymer, which is a copolymer of (meth)acrylamide and cationic monomer, preferably di methylaminoethyl acrylate, acryloyloxyethyltrimethylammonium chloride or diallyldimethyl ammonium chloride, and which has a charge density of 0.05-5 meq/g, preferably 0.1-3 meq/g, more preferably 0.3-2 meq/g, even more preferably 0.5-1.4 meq/g at pH 7, and an average molecular weight of 200 000-6 000 000 g/mol, preferably 300 000-3 000 000 g/mol, more preferably 500 000-2 000 000 g/mol, even more preferably 600 000-950 000 g/mol. The preferable first strength composition may also comprise non-degraded cationic starch, which has a degree of substitution in the range of 0.01-0.1, preferably 0.05-0.10.

The synthetic cationic polymer, which is used as a cationic agent in the first strength composition according to the second aspect, is preferably water-soluble. The term "water-soluble" is understood in the context of this application that the synthetic cationic polymer is fully miscible with water. When mixed with water, the synthetic cationic polymer is fully dissolved and the obtained polymer solution is essentially free from discrete polymer particles.

According to one embodiment of the second aspect of the invention cationic starch, which may be used as a cationic agent in the first strength composition, may be any suitable cationic starch used in paper making, such as potato, rice, corn, waxy corn, wheat, barley or tapioca starch, preferably corn starch or potato starch. Typically the amylopectin content of the cationic starch is in the range of 65-90%, preferably 70-85%. According to one embodiment at least 70 weight-% of the starch units of the cationic starch have an average molecular weight (MW) over 20 000 000 g/mol, preferably 50 000 000 g/mol, more preferably 100 000 000 g/mol.

For use as cationic agent in the first strength composition in the second aspect of the invention starch may be cationised by any suitable method. Preferably starch is cationised by using 2,3-epoxypropyltrimethylammonium chloride or 3-chloro-2-hydroxypropyltrimethylammonium chloride, 2,3-epoxypropyltrimethylammonium chloride being preferred. It is also possible to cationise starch by using cationic acrylamide derivatives, such as (3-acrylamidopropyl)-trimethylammonium chloride. Cationic starch has usually a degree of substitution (DS), which indicates the number of cationic groups in the starch on average per glucose unit, in the range of 0.01-0.5, preferably 0.02-0.3, more preferably 0.035-0.2, even more preferably 0.05-0.18, sometimes even preferably 0.05-0.15.

According to one preferred embodiment of the second aspect of the present invention the cationic starch, which is used as cationic agent in the first strength component, is non-degraded, which means that the starch has been modified solely by cationisation, and its backbone is non-degraded and non-cross-linked. Cationic non-degraded starch is of natural origin.

The first strength composition of the second aspect of the present invention may be added to the fibre stock in amount of 0.2-15 kg/ton, preferably 0.4-9 kg/ton produced paper, more preferably 1-5 kg/ton produced paper, calculated as dry product. The first strength composition is normally added to the thick fibre stock and/or before possible retention polymer addition. In this manner the interaction of the first strength composition with the fibres is improved and the desired strength effects are obtained more effectively. Thick stock is here understood as a fibrous stock or furnish, which has consistency of at least 20 g/l, preferably more than 25 g/l, more preferably more than 30 g/l.

According to one embodiment of the second aspect of the invention the second strength composition may be applied on the fibre web in concentration of 0.5-10 weight-%, preferably 1-8 weight-%, more preferably 4-7 weight-%, calculated of the dry matter content of the composition. The second strength composition is applied on the paper or board web surface by using sizing apparatuses and devices, such as film press, puddle or pond size press or spray application. The second strength composition may be applied on the web, for example, after the press section of the paper or board machine. According to one embodiment of the second aspect of the invention the second strength composition is applied on the paper or board web surface when the dryness of the web is >60%, preferably >80%. According to one embodiment paper is dried to at least 90% dryness and/or second strength composition is added before reeling of the paper roll.

In one embodiment of the second aspect of the invention the second strength composition may be applied on the fibre web in such amount that the anionic hydrophilic polymer is applied on the web in amount of 0.1-5 kg/dry paper ton, preferably 0.2-3 kg/dry paper ton, more preferably 0.5-2 kg/dry paper ton. The second strength composition may be applied on one side of the fibre web or on both sides of the fibre web.

According to one embodiment of the second aspect of the invention the anionic hydrophilic polymer of the second strength composition is a synthetic linear or cross-linked copolymer of (meth)acrylamide and at least one anionic monomer. Preferably the anionic monomer is selected from unsaturated mono- or dicarboxylic acids, such as acrylic acid, maleic acid, fumaric acid, itaconic acid, aconitic acid, mesaconic acid, citraconic acid, crotonic acid, isocrotonic acid, angelic acid or tiglic acid. Preferably the anionic hydrophilic polymer is a copolymer of acrylamide and acrylic acid. According to one embodiment of the second aspect of the invention the anionic hydrophilic polymer originates from >20 mol-% non-ionic monomers and 1-50 mol-%, preferably 2-25 mol-%, more preferably 4-17 mol-% anionic monomers. According to another embodiment the anionic hydrophilic polymer may comprise 1-90 mol-%, preferably 3-40 mol-%, more preferably 5-25 mol-%, even more preferably 6-18 mol-% of anionic monomers. The anionic hydrophilic polymer may also contain cationic groups, which give rise to local cationic charges in the polymer structure, as long as the net charge of the hydrophilic anionic polymer is anionic.

The anionic hydrophilic polymer of the second strength agent according to the second aspect may have an average molecular weight of 50 000-8 000 000 g/mol, preferably 150 000-3 000 000 g/mol, more preferably 250 000-1 500 000 g/mol, even more preferably 350 000-950 000 g/mol. Molecular weights are measured as described elsewhere in this application. The average molecular weight of the hydrophilic anionic polymer is optimised in view of SCT strength achieved.

Preferably also the second strength composition of the second aspect of the invention is free of inorganic mineral pigment particles.

According to one preferable embodiment of the second aspect of the present invention the second strength composition comprises a starch component, which may be any suitable starch used in surface sizing, such as potato, rice, corn, waxy corn, wheat, barley or tapioca starch, preferably corn starch. The amylopectin content of the starch component of the sizing strength composition may be in the range of 65-85%, preferably 75-83%. Starch component, which is used in the second strength composition, is preferably degraded and dissolved starch. Starch component may be enzymatically or thermally degraded starch or oxidized starch. The starch component may be degraded uncharged native starch or slightly anionic oxidized starch, preferably degraded uncharged native starch.

According to one embodiment of the second aspect of the invention the second strength composition comprises 0.1-20 weight-%, preferably 0.5-10 weight-%, more preferably 0.7-4 weight-% of anionic hydrophilic polymer, and 80-99.9 weight-%, preferably 90-99 weight-%, more preferably 96-99 weight-% of starch.

According to one preferable embodiment of the present invention the second strength composition of the second aspect of the invention corresponds to the surface size composition of the first aspect of the present invention.

According to one embodiment of the second the second strength composition may also contain other agents and additive substances, such as colourants, hydrophobation agents, etc. For example, the second strength composition may comprise a hydrophobation agent, which may comprise an acrylate polymer.

According to one embodiment of the second aspect of the invention the second strength composition may have a Brookfield viscosity, at 10% concentration, in the range of 2-200 mPas, preferably 20-60 mPas, measured at 60° C.

The sizing composition according to the first aspect of the present invention is especially suitable for surface sizing of the paper, board or the like, which comprises recycled fibres. According to one embodiment the paper or board to be treated with the composition preferably comprises at least 30% recycled fibres, preferably at least 70% recycled fibres, more preferably at least 90% recycled fibres, sometimes even 100% recycled fibres. Recycled fibres originate from old corrugated cardboard and/or mixed paper grades.

Furthermore, according to one embodiment of the first aspect of the present invention the surface sizing composition is especially suitable for treating the surface of the paper, which is selected from uncoated fine paper, or for treating the surface of the board, which is liner, fluting or folding boxboard (FBB). Uncoated fine paper may have grammage in the range of 60-250 g/m$^2$, preferably 70-150 g/m$^2$.

The method according to the second aspect of the present invention is advantageous for improving strength, especially burst strength, SCT strength or both, of the board web when producing paperboard like liner, fluting, folding boxboard (FBB), white lined chipboard (WLC), solid bleached sulphate (SBS) board, solid unbleached sulphate (SUS) board or liquid packaging board (LPB). In general, boards may have grammage from 60 to 500 g/m$^2$, or 70-500 g/m$^2$, preferably 80-180 g/m$^2$, and they may be based 100% on primary fibres, 100% on recycled fibres, or to any possible blend between primary and recycled fibres.

The first strength composition according to the second aspect is especially suitable for fibre thick stock having a zeta-potential value −35--1 mV, preferably −10--1, more preferably −7--1 mV, measured with Mütek SZP-06 Zeta potential tester before the addition of the first strength composition to the fibre stock.

The method according to the second aspect of the present invention may also be advantageous for improving strength of uncoated fine paper or base paper for coated fine paper, which have a grammage, for example, in the range of 40-250 g/m$^2$.

As explained above, the surface sizing composition according to the first aspect of the present invention improves SCT strength and burst strength of the produced paper and board, which is surface sized with it. This strength improvement makes it possible to increase the filler content in the paper. Thus, the sizing composition is suitable for sizing the surface of paper or board, which has an ash content of at least 6%, preferably at least 12%, more preferably at least 15%. For example, the ash content may be 3-20% for folding box board or 10-20%, preferably 15-20% for liner or fluting. Standard ISO 1762, temperature 525° C. is used for ash content measurements.

According to one embodiment of the invention the application temperature of the sizing composition or second strength composition is >50° C., preferably 50-90° C., more preferably 65-85° C., even more preferably 60-80° C. This improves the stability of the sizing strength component, especially when it comprises a starch component. The sizing and strength compositions according to the present invention thus tolerate even high application temperatures, without degradation or other negative effects. The sizing composition and second strength composition may be applied on the surface of paper, board or the like in a conventional surface sizing arrangement, such as metering size press, pond size press or spray sizer.

The sizing composition according to the first aspect of the invention is applied on the surface of the paper or board web in amount of 5-80 kg/ton paper/board as dry, preferably 10-50 kg/ton paper/board as dry. For example, when producing liner or fluting the sizing composition is added preferably in amount of 25-70 kg/ton board as dry. Alternatively, when producing folding boxboard or uncoated fine paper, the sizing composition is added preferably in amount of 5-30 kg/ton paper/board as dry. In general, it has been observed that in comparison to conventional sizes, similar or even better sizing results may be obtained with the sizing composition according to the present invention, even if the applied size amounts may be even 20% less than the conventional amounts According to one embodiment of the invention, when producing liner or fluting, the sizing composition according to the first aspect is applied on the surface of the web in amount of 0.5-4 g/m$^2$/side, preferably 0.5-3.5 g/m$^2$/side.

According to one embodiment of the invention, when producing folding box board or fine paper grades, the sizing composition according to the first aspect is applied on the surface of the web in amount of 0.3-2 g/m$^2$/side.

In the present context the term "fibre stock" is understood as an aqueous suspension, which comprises fibres and optionally fillers. The final paper or board product, which is made from the fibre stock may comprise at least 5%, preferably 10-30%, more preferably 11-19% of mineral filler, calculated as ash content of the uncoated paper or board product. Mineral filler may be any filler conventionally used in paper and board making, such as ground calcium carbonate, precipitated calcium carbonate, clay, talc, gypsum, titanium dioxide, synthetic silicate, aluminium trihydrate, barium sulphate, magnesium oxide or their any of mixtures. The fibres in the fibre stock preferably originate from recycled paper, old corrugated containerboard (OCC), unbleached kraft pulp, and/or neutral sulphite semi chemical (NCCS) pulp. According to one preferred embodiment of the second aspect the fibre stock to be treated with the first strength composition comprises at least 20 weight-%, preferably at least 50 weight-% of fibres originating from recycled paper or board. In some embodiments the fibre stock may comprise even >70 weight-%, sometimes even >80 weight-%, of fibres originating from recycled paper or board.

The sizing composition and second strength composition according to the first and second aspects of the invention are preferably free of any cationic synthetic polymer components. Furthermore, the sizing composition and second strength composition are free of added inorganic soluble salts, such as alkali metal and/or alkali earth metal salts.

According to one embodiment the method for producing paper, board or the like, comprises

- adding a first strength composition, which comprises a cationic agent, to a fibre stock,
- forming a fibrous web from the fibre stock,
- drying the fibrous web to dryness of at least 60%,
- applying on the surface of the fibrous web a sizing strength composition, which comprises an anionic hydrophilic polymer and optionally a starch component.

EXPERIMENTAL

Some embodiments and aspects of the invention are described in the following, non-limiting, examples.

Table 1 lists abbreviations for dry anionic polyacrylamides, which are used in some of the following examples 3-7. The dry anionic polymers are dissolved in water before use, at 1.5 weight-% active polymer concentration.

Abbreviations for anionic polyacrylamides, which are used in the following examples 2-7, are listed in Table 2. Polyacrylamides in Table 2 are solution polymers. The viscosities for the polymer are determined at 10 weigh-% concentration. The cross-linker, if used, was methylene bisacrylamide.

Example 1: General Procedure for Synthesis of Anionic Polyacrylamide Solution Anionic polyacrylamides were synthesized by radical polymerization using the following general procedure. Prior to polymerization monomer mixture was prepared in a monomer tank by mixing all monomers (including possible cross-linker monomers), water, Na-salt of EDTA and sodium hydroxide. This mixture is called hereafter "Monomer mixture". The monomer mixture was purged with nitrogen gas for 15 min.

Catalyst solution was made in a catalyst tank by mixing water and ammonium persulfate. The mixture is called hereafter "Catalyst solution" and it was made less than 30 min before use.

Water was added into a polymerization reactor equipped with mixer and a jacket for heating and/or cooling. The water was purged with nitrogen gas for 15 min. The water was heated to 100° C. Both "Monomer mixture" and "Catalyst solution" feeds were started at the same time. Feed time for "Monomer mixture" was 90 min and for "Catalyst solution" 100 min. When the feed of "Catalyst solution" was completed, the mixture in the polymerization reactor was mixed for 45 min. The mixture was cooled to 30° C. and then the aqueous polymer solution was removed from the reactor.

The following characteristics were analyzed for the obtained aqueous polymer solution. Dry solids content was analyzed by using Mettler Toledo HR73, at 150° C. Viscosity was analyzed by Brookfield DVI+, equipped with small sample adapter, at 25° C., using spindle S18 for solutions with viscosity <500 mPas and spindle S31 for solutions, with viscosity 500 mPas or higher, and using the highest feasible rotation speed for the spindle. pH of the solution was analyzed by using calibrated pH-meter.

Example 2: Synthesis of Test Polymer AC17HM

Synthesis of test polymer AC17HM is described as a production example in detail.

Prior to the polymerization a monomer mixture was prepared in a monomer tank by mixing 42.4 g of water, 188 g of 50% aqueous solution of acrylamide, 19.5 g acrylic acid, 0.59 g of 39% aqueous solution of Na-salt of EDTA and 10.8 g of 50% aqueous solution sodium hydroxide. Monomer mixture was purged with nitrogen gas for 15 min.

A catalyst solution was prepared in a catalyst tank by mixing 27 g water and 0.08 g ammonium persulfate.

440 g of water was added in a polymerization reactor. The polymerization was performed as described above in Example 1.

The following characteristics were determined form test product AC17HM: dry solids content 15.1%, viscosity 7700 mPas, pH 5.1. The polymer solution was diluted with water to concentration of 10%. Viscosity of the diluted polymer solution was 1200 mPas.

Example 3: Size Press Test

Preparation of Surface Size Compositions

A 15 weight-% solution of dextrinated surface size starch (C*Film 07311, Cargill) is cooked for 30 min at 95° C. The starch was selected to simulate enzymatically degraded native starch. Surface size compositions are prepared by mixing of water, starch and used chemicals, in this order. This means that anionic polyacrylamide and 1 weight-% cationic acrylate based hydrophobisation agent (Fennosize S3000, Kemira Oyj), calculated as dry, was added to the cooked surface size starch solution, and mixed at 70° C., for at least 2 min. Starch, the used anionic polyacrylamides and their amounts in weigh-%, calculated as dry, are listed in Table 3. Viscosity of the obtained composition was measured by using Brookfield Visco cP, Spindle 18, 100 rpm, 60° C., at 9% concentration. The surface size compositions were stored at 70° C. until surface sizing experiments were carried out.

Surface Sizing Experiments

Size press parameters were as follows:

Size press manufacturer: Werner Mathis AG, CH 8155 Niederhasli/Zürich; Size press model: HF 47693 Type 350; Operation speed: 2 m/min; Operation pressure: 1 bar; Operation temperature: 60° C.; Sizing solution volume: 140 ml/test; Sizing times/sheet: 2.

Sizing is performed in machine direction and the surface size composition is applied as 12 weight-% solution.

Base paper was Schrenz paper, 100 g/m$^2$, 100% recycled fibre based liner grade without size press. The base paper had an ash content of 16.4% (standard ISO 1762, temperature 525° C.) and bulk value 1.57 cm$^3$/g (measured with standard ISO 534).

Drying of the sized sheets was made in one-cylinder felted steam heated dryer drum at 95° C. for 1 min. Shrinkage was restricted in dryer.

The test samples are sized twice, and the properties of the sized sheets are measured. The used measurements, testing devices and standards are given in Table 4.

The measured results after one pass are given in Table 5 and after two pass in Table 6. The percentage values for pick-up in Table 5 and 6 are calculated from weight increase of an air-conditioned sheet, where the basis weight of the sheet is measured before and after sizing. The percentage values for starch saving in Table 5 and 6 are calculated as the ratio of the pick-up value of an individual test sample and the pick-up value of the reference. The indexed values in Table 5 and 6 are given as the strength divided by the basis weight of the paper/board. The geometric (GM) value is the square root of (MD value)*(CD value). MD value is the measured strength value in machine direction and CD value is the measured strength value in machine cross direction.

It can be seen from results in Table 5 for test samples 2 and 6, where the amount of the polymer in the sizing composition was 2.5% that after one pass the obtained values for SCT GM index and CMT30 index are clearly improved when they are compared to comparative test sample 4 with the same polymer content. When improvements in strength results are obtained even at low polymer dosage the overall process economy is improved.

Furthermore, it can be seen from results in Table 5 for test samples 3 and 7, where the amount of the polymer in the sizing composition was 7.5%, that the obtained values for SCT GM index, burst Index and CMT30 index are similar or improved when they are compared to comparative test sample 5 with the same polymer content. Clear and unexpected improvement can be seen in the obtained Cobb60 values, which indicates that the compositions according to the present invention gave better hydrophobication effect. Further, higher dry content and higher starch savings could be obtained.

The results after two pass are given in Table 6. The results are similar to those in given in Table 5. This means that improvements for test samples 2 and 6 in obtained values for SCT GM index and CMT30 index can be observed when they are compared to comparative test sample 4. Similarly, it can be seen from results in Table 6 for test samples 3 and 7 that the obtained values for SCT GM index, burst Index and CMT30 index are similar or improved when they are compared to comparative test sample 5 with the same polymer content. Clear improvements are again seen in the obtained Cobb60 values, as well as dry content and starch savings.

Example 4: Size Press Test

The surface sizing compositions are prepared in the same manner as in Example 3.

The surface sizing experiments are carried out in the same manner and using the same base paper as in Example 3, except for following points:

- the test samples are sized only once, the sizing volume being 100 ml;
- the experiments are carried out for each test sample by sizing both at 6 weight-% and 12 weight-% concentration, in which case the pick-up was about 3% and 5%, respectively. The results for each test sample were calculated linearly to correspond 3.5% pick-up.

The results of Example 4 are given in Table 7. The indexed values are calculated in the same manner than in Example 3.

It can be seen from Table 7 that the surface size compositions according to the present invention provide simultaneous improvement, i.e. increase, in SCT GM Index and burst index. Furthermore, it can be observed that for test sample 16 the CMT30 index is clearly improved, even if the polymer content in the size composition is only 2.5%.

Further, from Table 7 it could be anticipated that the surface size compositions comprising polymer with higher molecular weight have especially good performance results. It is speculated that low level of cross-linking or no cross-linking of the polymer might be beneficial for the performance.

Example 5: Size Press Test

The surface sizing compositions are prepared in the same manner as in Example 3, except that no hydrophobisation agent was used.

The surface sizing experiments are carried out in the same manner and using the same base paper as in Example 3, except that the test samples are sized only once, the sizing volume being 100 ml.

Starch, the used anionic polyacrylamides and their amounts in weigh-%, calculated as dry, are listed in Table 8. The results of Example 5 are shown in Table 9. The pick-up values and the indexed values are calculated in the same manner than in Example 3.

It can be seen from Table 9 that even if some improvement in SCT GM index and burst strength index can be observed for all the used surface size compositions, the improvement was more pronounced when the composition comprised polymer with higher anionicity, see the test samples 2 and 3 of Table 9.

Example 6: Size Press Test

The surface sizing compositions are prepared in the same manner as in Example 3, except that no hydrophobisation agent was used and the surface starch used was Stabilys A020 (Roquette, France).

The surface sizing experiments are carried out in the same manner and using the same base paper as in Example 3, except for the following points:

- the surface size composition was applied as 9 weight-% solution,
- the applicator rolls of the sizing apparatus were heated in 82° C. water bath.

Starch, the used anionic polyacrylamides and their amounts in weigh-%, calculated as dry, are listed in Table 10. The results of Example 6 are shown in Table 11. The pick-up values and indexed values are calculated in the same manner than in Example 3.

It can be seen from Table 11 that when the surface size composition comprises polymer with too low molecular weight (Test sample 2) or polymer with too high molecular weight (Test samples 3 and 4) the simultaneous improvement of both SCT GM index and burst index is not achieved.

Example 7: Size Press Test

The surface sizing compositions are prepared in the same manner as in Example 3. Hydrophobisation agent was used in some of the surface size compositions, see Table 12.

The surface sizing experiments are carried out in the same manner as in Example 3, except for the following points:

- the surface size composition was applied as 9 weight-% solution,
- base paper was Schrenz paper, 105 g/m$^2$, 100% recycled fibre based liner grade without size press. The base paper had an ash content of 15.9% (measured with standard ISO 1762, temperature 525° C.) and bulk value 1.75 cm$^3$/g (measured with standard ISO 534).

Starch, the used anionic polyacrylamides and their amounts in weigh-%, calculated as dry, are listed in Table 12. The results of Example 7 are shown in Table 13. The pick-up values and the indexed values are calculated in the same manner than in Example 3.

It can be seen from Table 13 that the size compositions according to the present invention comprising polymers with higher molecular weight and anionicity than the polymer, which was used in comparative the surface size of test samples, provide better SCT strength and similar or better burst strength, when the polymer amounts in the surface size compositions are taken into account. Furthermore, it can be observed that the surface size composition of test sample 9 could provide an improved strength properties even if it comprised hydrophobisation agent.

Example 8

Commercial Central European Old Corrugated Container (OCC) stock from Central Europe was used as raw material in Example 8.

OCC was disintegrated from bales with mill water to achieve consistency of 2.3% for the test stock suspension. Disintegration was performed by using Andritz laboratory refiner for 35 minutes with open fillings, i.e. refiner blades were open in order to avoid refining effect. The properties of the disintegrated OCC stock and the mill water used are given in Table 14.

Papermaking agents and compositions used in Example 8 are given in Table 15. The molecular weights in Table 15 are measured by using gel permeation chromatography employing size exclusion chromatographic columns with polyethylene oxide (PEO) calibration, if not otherwise indicated.

The used papermaking agents and compositions were dosed into the disintegrated OCC stock. Fresh mill water was used as process water, which was fed into a mixing tank with the disintegrated OCC stock under agitation. Thus the stock was diluted to headbox consistency of 1% with the fresh mill water.

The diluted stock suspension was fed to a headbox of a pilot paper machine. A retention polymer and colloidal silica were used as retention aids. Retention polymer was added before the headbox pump of the pilot paper machine, and the colloidal silica was dosed before the headbox of the pilot paper machine. The used retention polymer was a cationic copolymer of acrylamide, molecular weight about 6,000,000 g/mol, charge density 10 mol-%. Colloidal silica had an average particle size of 5 nm. Retention polymer dosage was 100 g/ton of dry product, and colloidal silica dosage was 200 g/ton of dry product OCC liner and fluting sheets having basis weight of 100 g/m$^2$ were produced on a pilot paper machine. Operational parameters of the pilot paper machine were as follows:

Running speed: 2 m/min; Web width: 0.32 m; Rotation speed of the holey roll: 120 rpm; Press section: 2 nips; Drying section: 8 pre-drying cylinders, baby cylinder, 5 drying cylinders.

After the manufacture, the sheets were size pressed with dextrinated starch C*film 07311 (Cargill). This degraded starch simulates enzymatically degraded native starch. Sizing amount was 50 kg/t dry. Size press parameters were as follows: Size press manufacturer: Werner Mathis AG, CH 8155 Niederhasli/Zürich; Size press model: HF 49895; Operation speed: 3 m/min; Operation pressure: 1.5 bar; Operation temperature: 70° C.; Sizing solution volume: 300 ml; Sizing times/sheet: 2. Drying of the sized sheets was done in one-cylinder felted steam heated dryer drum at 93° C. for 2 min. Shrinkage was restricted in dryer.

Before testing of the strength properties of the produced liner sheets, they were pre-conditioned for 24 h at 23° C. in 50% relative humidity according to standard ISO 187. Devices and standards, which were used to measure the properties of the sheets, are given in Table 4, except for SCT, where Lorentzen & Wettre Compression Strength tester was used, according to standard ISO 9895.

The results for strength property tests are given in Table 16. The results in Table 16 are indexed: obtained burst strength and SCT measurement values are indexed by dividing each obtained measurement value by basis weight of the measured sheet. SCT strength was then calculated as geometrical mean of machine direction strength and cross direction strength.

From the results of Table 16 it can be seen that both the burst strength and SCT strength are clearly improved when the method according to the present invention is used, i.e. a first strength composition comprising at least one cationic agent is added to the pulp and a second strength composition which comprises anionic hydrophilic polymer is applied on the sheet surface. The combination according to second aspect of the invention, i.e. the first strength composition added before second strength composition, makes it possible to reduce the amount of anionic hydrophilic polymer, which is applied on the surface of the fibrous web, while obtaining similar or higher strength properties.

Example 9

Example 9 was performed in the same manner and by using the same raw materials, papermaking agents and compositions and test methods as Example 8. Basis weight of the produced base paper was 110 g/m$^2$.

The results for strength property tests of Example 9 are given in Table 17.

It can be seen from results in Table 17 that the sheets prepared according to the second aspect of the present invention show similar or even improved burst index values as the reference samples. It should be noted that all sheets prepared according to the second aspect of the present invention show lower size pick values. This means that the similar or even better burst index values are obtained by using lower amounts of size, which gives considerable savings in material used.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

TABLE 1

Anionic polyacrylamides, dry polymers, which are used in Examples 3-7.

| Abbreviation | Remark | Anionicity [mol-%] | Molecular Weight, Ubbelohde [Mg/mol] |
|---|---|---|---|
| LMA-V-2 | | 12.5 | 1.4 |
| LK4358/1 | comparative | 5 | 2.7 |

TABLE 2

Anionic polyacrylamides, solution polymers, which are used in Examples 3-7.

| Abbreviation | Remark | Anionicity [mol-%] | Viscosity [mPas] | Molecular Weight [Mg/mol] | Cross-linker [mol-%, of total monomers] |
|---|---|---|---|---|---|
| AC8H | | 8 | 4300 | 0.5 | — |
| AC8M | comparative | 8 | 300 | 0.44 | — |
| AC8L | comparative | 8 | 83 | 0.34 | — |
| AC20H | | 20 | 9560 | 0.71 | — |
| AC20M | comparative | 20 | 360 | 0.46 | — |
| AC20L | comparative | 20 | 70 | 0.33 | — |
| AC32H | | 32 | 4400 | 0.65 | — |
| AC32M | comparative | 32 | 236 | 0.42 | — |
| AC32L | comparative | 32 | 63 | 0.32 | — |
| AC13HM | | 12.5 | 1170 | 0.55 | — |
| AC4H | | 4 | 6400 | 0.68 | — |
| AC17HM | | 17 | 1200 | 0.55 | — |
| AC8H-CL2 | | 8 | 9940 | 0.71 | 0.018 |
| AC20M-CL1 | comparative | 20 | 194 | 0.41 | 0.030 |
| AC11HM | | 11 | 1070 | 0.54 | — |

TABLE 3

Anionic polyacrylamides and their amounts in weigh-% for Example 3.

| Test Sample # | Remark | Starch [%] | Polymer/ | Polymer [%] | Composition Viscosity [mPas] |
|---|---|---|---|---|---|
| 1 | reference | 99 | — | 0 | 3.2 |
| 2 | | 96.5 | AC8H | 2.5 | 7.9 |
| 3 | | 91.5 | AC8H | 7.5 | 18.9 |
| 4 | comparative | 96.5 | AC8M | 2.5 | 5.8 |
| 5 | comparative | 91.5 | AC8M | 7.5 | 11.2 |
| 6 | | 96.5 | AC13HM | 2.5 | 8.2 |
| 7 | | 91.5 | AC13HM | 7.5 | 21.7 |

TABLE 4

Sheet testing devices and standards used.

| Measurement | Device | Standard |
|---|---|---|
| Basis weight | Mettler Toledo | ISO 536 |
| SCT GM Index (Short Span Compression test) | Lorentzen & Wettre Compression Strength tester | ISO 9895 |
| Burst strength | IDM Test EM-50/80 | ISO 2758 |
| CMT30 Index | Sumet-Messtechnik SC-500 Fluter: PTA Group AV-S | ISO 7263: 1994 |
| Cobb60 | — | ISO 535 |

TABLE 5

The measured results after one pass in Example 3.

| Test Sample # | Remark | Penetrated Polymer [kg/t dry] | Pick-up [%] | SCT GM Index [Nm/g] | Burst Index [kPam$^2$/g] | CMT30 Index [Nm$^2$/g] | Cobb60 [g/m]2 | Dry content [%]* | Starch saving [%] |
|---|---|---|---|---|---|---|---|---|---|
| 1 | ref. | 0 | 4.2 | 23.8 | 1.98 | 1.29 | 106 | 74 | 0 |
| 2 | | 1.0 | 3.8 | 24.1 | 2.12 | 1.25 | 90 | 76 | 8.6 |
| 3 | | 2.7 | 3.6 | 24.5 | 2.06 | 1.28 | 80 | 77 | 15.0 |
| 4 | comp. | 1.0 | 3.9 | 23.6 | 2.12 | 1.24 | 97 | 75 | 6.9 |
| 5 | comp. | 2.8 | 3.7 | 24.1 | 2.10 | 1.29 | 100 | 76 | 11.0 |
| 6 | | 0.9 | 3.4 | 24.3 | 2.11 | 1.28 | 93 | 78 | 17.9 |
| 7 | | 2.3 | 3.1 | 24.7 | 2.21 | 1.29 | 83 | 80 | 26.5 |

*dry content after size press

TABLE 6

The measured results after two passes in Example 3.

| Test Sample # | Remark | Penetrated Polymer [kg/t dry] | Pick-up [%] | SCT GM Index [Nm/g] | Burst Index [kPam$^2$/g] | CMT30 Index [Nm$^2$/g] | Cobb30 [g/m]2 | Dry content [%]* | Starch saving [%] |
|---|---|---|---|---|---|---|---|---|---|
| 1 | ref. | 0 | 7.0 | 25.2 | 2.01 | 1.36 | 93 | 63 | 0 |
| 2 | | 1.6 | 6.3 | 26.8 | 2.22 | 1.47 | 30 | 66 | 12.7 |
| 3 | | 4.5 | 6.0 | 27.3 | 2.28 | 1.48 | 25 | 67 | 21.8 |
| 4 | comp. | 1.6 | 6.5 | 25.8 | 2.07 | 1.40 | 58 | 65 | 10.6 |
| 5 | comp. | 4.7 | 6.3 | 26.5 | 2.30 | 1.49 | 40 | 66 | 17.8 |
| 6 | | 1.5 | 5.9 | 26.6 | 2.20 | 1.45 | 26 | 67 | 18.8 |
| 7 | | 4.1 | 5.4 | 27.6 | 2.45 | 1.51 | 27 | 69 | 28.6 |

*dry content after size press

TABLE 7

Results of Example 4.

| Test Sample # | Remark | Polymer | Starch [%] | Polymer [%] | Viscosity [mPas] | SCT GM Index* [%] | Burst Index* [%] | CMT30 Index* [%] |
|---|---|---|---|---|---|---|---|---|
| 1 | reference | — | 100 | 0 | 4 | 0 | 0 | 0 |
| 2 | | AC20H | 97.5 | 2.5 | 28 | 3.3 | 5.3 | 4.5 |
| 3 | | AC20H | 92.5 | 7.5 | 65 | 4.5 | 9.0 | 4.3 |
| 4 | comparative | AC32M | 97.5 | 2.5 | 10 | 1.0 | 6.9 | 4.0 |
| 5 | comparative | AC32M | 92.5 | 7.5 | 21 | 2.8 | 11.0 | 5.8 |
| 6 | comparative | AC20M | 97.5 | 2.5 | 15 | 3.8 | 3.0 | 0.5 |
| 7 | comparative | AC20M | 92.5 | 7.5 | 28 | 4.3 | 6.0 | 4.9 |
| 8 | comparative | AC8M | 97.5 | 2.5 | 8 | −0.8 | 4.7 | 2.1 |
| 9 | comparative | AC8M | 92.5 | 7.5 | 15 | 5.6 | 5.4 | 5.4 |
| 10 | comparative | AC20L | 97.5 | 2.5 | 9 | 3.0 | −1.5 | 5.0 |
| 11 | comparative | AC20L | 92.5 | 7.5 | 15 | 4.5 | 5.7 | 1.5 |
| 12 | comparative | AC20M-CL1 | 97.5 | 2.5 | 14 | 2.6 | 0.9 | 2.6 |
| 13 | comparative | AC20M-CL1 | 92.5 | 7.5 | 27 | 4.7 | 4.4 | 4.0 |
| 14 | | AC32H | 97.5 | 2.5 | 28 | 2.4 | 4.5 | 4.8 |
| 15 | | AC32H | 92.5 | 7.5 | 72 | 5.7 | 8.9 | 2.9 |
| 16 | | AC8H | 97.5 | 2.5 | 15 | 4.2 | 8.0 | 5.3 |
| 17 | | AC8H | 92.5 | 7.5 | 33 | 8.7 | 13.8 | 5.6 |

TABLE 7-continued

Results of Example 4.

| Test Sample # | Remark | Polymer | Starch [%] | Polymer [%] | Viscosity [mPas] | SCT GM Index* [%] | Burst Index* [%] | CMT30 Index* [%] |
|---|---|---|---|---|---|---|---|---|
| 18 | comparative | AC8L | 97.5 | 2.5 | 7 | 2.3 | 0.5 | 1.7 |
| 19 | comparative | AC8L | 92.5 | 7.5 | 11 | 5.3 | 10.6 | 4.2 |
| 20 | | AC8H-CL2 | 97.5 | 2.5 | 15 | 4.3 | 7.0 | −0.8 |
| 21 | | AC8H-CL2 | 92.5 | 7.5 | 31 | 7.4 | 13.1 | 3.6 |

*values are given as increase %, calculated from the values for the reference

TABLE 8

Anionic polyacrylamides and their amounts in weigh-% for Example 5.

| Test Sample # | Remark | Starch [%] | Polymer | Polymer [%] | Composition Viscosity [mPas] |
|---|---|---|---|---|---|
| 1 | reference | 100 | — | 0 | 3.5 |
| 2 | | 97.5 | AC13HM | 2.5 | 12.1 |
| 3 | | 92.5 | AC13HM | 7.5 | 27.1 |
| 4 | | 97.5 | AC4H | 2.5 | 8 |
| 5 | | 92.5 | AC4H | 7.5 | 17.4 |

TABLE 9

Results of Example 5.

| Test Sample # | Remark | Penetrated Polymer [kg/t dry] | Pick-up [%] | SCT GM Index increase* [%] | Burst Index increase* [%] | Dry content* [%] |
|---|---|---|---|---|---|---|
| 1 | reference | 0.0 | 3.8 | 0.0 | 0.0 | 76 |
| 2 | | 0.9 | 3.4 | 3.7 | 4.6 | 78 |
| 3 | | 2.4 | 3.3 | 2.4 | 9.2 | 79 |
| 4 | | 0.8 | 3.3 | 1.1 | 1.5 | 79 |
| 5 | | 2.4 | 3.2 | 1.9 | 4.3 | 79 |

*values are given as increase %, calculated from the values for the reference

TABLE 10

Anionic polyacrylamides and their amounts in weigh-% for Example 6.

| Test Sample # | Remark | Starch [%] | Polymer/ | Polymer [%] | Composition Viscosity [mPas] |
|---|---|---|---|---|---|
| 1 | reference | 100 | — | — | 7.25 |
| 2 | comparative | 97.5 | AC8M | 2.5 | 12.6 |
| 3 | comparative | 99 | LK4358/1 | 1 | 22.3 |
| 4 | comparative | 97.5 | LK4358/1 | 2.5 | 31.2 |
| 5 | | 97.5 | AC13HM | 2.5 | 20.9 |

TABLE 11

Results of Example 6.

| Test Sample # | Remark | Penetrated Polymer [kg/t dry] | Pick-up [%] | SCT GM Index [Nm/g] | Burst Index [kPam$^2$/g] |
|---|---|---|---|---|---|
| 1 | reference | 0 | 3.8 | 25.9 | 2.3 |
| 2 | comparative | 0.9 | 3.7 | 25.9 | 2.3 |
| 3 | comparative | 0.4 | 4.3 | 24.8 | 2.2 |
| 4 | comparative | 1.1 | 4.3 | 24.3 | 2.2 |
| 5 | | 0.9 | 3.6 | 26.1 | 2.4 |

TABLE 12

Anionic polyacrylamides and their amounts in weigh-% for Example 7.

| Test Sample # | Remark | Starch [%] | Hydrophob. Agent [%] | Polymer | Polymer [%] | Viscosity [mPas] |
|---|---|---|---|---|---|---|
| 1 | ref. | 100 | — | — | — | 7.25 |
| 2 | comp. | 97.5 | — | AC8M | 2.5 | 12.6 |

TABLE 12-continued

Anionic polyacrylamides and their amounts in weigh-% for Example 7.

| Test Sample # | Remark | Starch [%] | Hydrophob. Agent [%] | Polymer | Polymer [%] | Viscosity [mPas] |
|---|---|---|---|---|---|---|
| 3 | comp. | 95 | — | AC8M | 5 | 22.3 |
| 4 | | 97.5 | — | AC11HM | 2.5 | 31.2 |
| 5 | | 95 | — | AC11HM | 5 | 20.9 |
| 6 | | 97.5 | — | LMA-V-2 | 2.5 | 20.9 |
| 7 | | 95 | — | LMA-V-2 | 5 | 20.9 |
| 8 | ref. | 99 | 1 | — | — | 20.9 |
| 9 | | 96.5 | 1 | AC11HM | 2.5 | 20.9 |

TABLE 13

Results of Example 7.

| Test Sample # | Remark | Penetrated Polymer [kg/t dry] | Pick-up [%] | SCT GM Index [Nm/g] | Burst Index [kPam$^2$/g] |
|---|---|---|---|---|---|
| 1 | reference | 0.0 | 9.2 | 22.9 | 1.96 |
| 2 | comparative | 2.3 | 9.4 | 23.3 | 2.10 |
| 3 | comparative | 4.5 | 9.0 | 23.7 | 2.13 |
| 4 | | 2.4 | 9.4 | 24.0 | 2.11 |
| 5 | | 4.5 | 9.0 | 24.1 | 2.13 |
| 6 | | 2.3 | 9.2 | 23.7 | 2.06 |

TABLE 13-continued

Results of Example 7.

| Test Sample # | Remark | Penetrated Polymer [kg/t dry] | Pick-up [%] | SCT GM Index [Nm/g] | Burst Index [kPam$^2$/g] |
|---|---|---|---|---|---|
| 7 | | 4.5 | 8.9 | 25.2 | 2.26 |
| 8 | reference | 0.0 | 8.9 | 22.6 | 1.98 |
| 9 | | 2.2 | 8.8 | 23.1 | 2.03 |

TABLE 14

Characteristics of disintegrated OCC stock and mill water used in Example 8.

| Characteristic | Disintegrated OCC stock | Mill water | Device/standard used for measurement |
|---|---|---|---|
| pH | — | 7.5 | Knick Portamess 911 |
| Conductivity | 1.9 | 2.5 | Knick Portamess 911 |
| Charge (μeq/l) | −262 | −283 | Mütek PCD 03 |
| Zeta potential (mV) | −8.7 | — | Mütek SZP-06 |
| Consistency (g/l) | 23 | — | ISO 4119 |
| Ca-content (mg/l) | — | 643 | ISO 777 |
| Alkanity (mmol/l) | — | 2.2 | ISO 9963 |
| COD (mg/l) | 1013 | 630 | ISO 6060 |

TABLE 15

Papermaking agents and compositions used in Example 1.

| Abbreviation | Agent/Composition | Charge at pH 7, meq/g dry | Molecular Weight, $10^6$ g/mol | Comment |
|---|---|---|---|---|
| STA | Cationic waxy starch | 0.4 | | Cooked starch |
| STA2 | Cationic potato starch | 0.2 | | Cooked starch |
| CPAM1 | Copolymer of acrylamide-acryloyloxyethyltrimethyl ammoniumchloride (ADAM-Cl) | 1.3 | ~0.8 | Cationic polymer |
| GPAM | Copolymer of glyoxylated acrylamide and DADMAC | 2 | ~0.4 | Cationic crosslinked polymer |
| APAM1 | Copolymer of acrylamide and acrylic acid | −1.1 | ~0.5 | Anionic polymer |
| APAM2 | MBA copolymer of acrylamide and acrylic acid** | −2.8 | ~0.5 | Anionic crosslinked polymer |

*The degree of hydrolysis is 40 mol-%. Active polymer content is 74%. The percentage of hydrolysis degree gives the amount of monomers having amine functionality in their structure.
**crosslinker: methylenebisacrylamide (MBA) 600 ppm of monomers

TABLE 16

Results of strength property tests of Example 8.

| Pulp Additive | Pulp Additive Dose [kg/ton] | Size Additive | Size Additive Dose [kg/ton] | SCT Geom. ind. [kNm/kg] | Burst index [kPam$^2$/g] |
|---|---|---|---|---|---|
| — | — | — | — | 22.4 | 2.15 |
| — | — | APAM1 | 2.8 | 23.6 | 2.21 |
| — | — | APAM1 | 5.7 | 26.1 | 2.53 |
| CPAM + STA | 0.5 + 0.5 | — | — | 24.5 | 2.17 |
| CPAM + STA | 0.5 + 0.5 | APAM1 | 2.7 | 26.4 | 2.57 |
| CPAM + STA | 0.5 + 0.5 | APAM1 | 5.4 | 28.1 | 2.49 |

TABLE 17

Results of strength property tests of Example 9.

| Pulp Additive | Pulp Additive Dose [kg/ton] | Size Additive | Size Additive Dose [kg/ton] | Size pick up [%] | Burst index [kPam²/g] | Comment |
|---|---|---|---|---|---|---|
| STA2 | 10 | — | — | 6.8 | 2.8 | Reference |
| STA2 | 10 | APAM1 | 3.2 | 6.4 | 3.1 | Good |
| STA2 | 10 | APAM1 | 5.9 | 5.9 | 3.1 | Good |
| GPAM | 1 | — | | 7.9 | 2.9 | Reference |
| GPAM | 1 | APAM1 | 3.8 | 7.5 | 2.9 | Good |
| GPAM | 1 | APAM1 | 7.1 | 7.1 | 3.0 | Good |
| CPAM1 + STA | 0.5 + 0.5 | — | — | 8.4 | 3.0 | Reference |
| CPAM1 + STA | 0.5 + 0.5 | APAM2 | 3.6 | 7.2 | 3.1 | Good |
| CPAM1 + STA | 0.5 + 0.5 | APAM2 | 6.9 | 6.9 | 3.2 | Good |

The invention claimed is:

1. A sizing composition for sizing of a surface of paper, or board, the sizing composition having a solids content of 3-30% and comprising:

degraded non-ionic starch, and at least 0.5-10 weight-% of anionic polyacrylamide, which has an average molecular weight, MW, in a range of 540,000 g/mol to 1,400,000 g/mol, and an anionicity in a range of 4-35 mol-%.

2. The composition according to claim 1, wherein the anionic polyacrylamide has the average molecular weight in a range of 650,000-1,400,000 g/mol.

3. The composition according to claim 1, wherein the anionic polyacrylamide has the anionicity in a range of 4-24 mol-%, 4-17 mol-% or 5-17 mol-%.

4. The composition according to claim 1, wherein the anionic polyacrylamide has the anionicity in a range of 7-15 mol-% or 9-13 mol-%.

5. The composition according to claim 1, wherein the anionic polyacrylamide is a copolymer of acrylamide and unsaturated carboxylic acid monomers, being (meth)acrylic acid, maleic acid, crotonic acid, itaconic acid or their mixture.

6. The composition according to claim 1, wherein the composition comprises 0.75-5 weight-% or 1-2.5 weight-%, of anionic polyacrylamide.

7. The composition according to claim 1, wherein the starch is enzyme treated or thermally degraded starch.

8. The composition according to claim 1, wherein the starch, prior to its degradation, has an amylase content of 15-30%, 20-30% or 24-30%.

9. The composition according to claim 1, wherein the composition is free from inorganic mineral fillers or pigments.

10. A method for producing paper, board or the like, which method comprises:

adding a first strength composition, which comprises a cationic agent, to a fibre stock, forming a fibrous web from the fibre stock, drying the fibrous web to dryness of at least 60%, and applying on the surface of the fibrous web a second strength composition having a solids content of 3-30%, which comprises at least 0.5-10 weight-% of an anionic hydrophilic polymer which is a anionic polyacrylamide, which has an average molecular weight, MW, in a range of 540,000 g/mol to 1,400,000 g/mol, and an anionicity in a range of 4-35 mol-%, and a starch component, which is degraded non-ionic starch.

11. The method according to claim 10, wherein the cationic agent in the first strength composition comprises cationic starch or at least one cationic synthetic polymer or a mixture of cationic starch and cationic synthetic polymer (s).

12. The method according to claim 11, wherein the cationic synthetic polymer is selected from a group comprising copolymers of (meth)acrylamide and cationic monomers; glyoxylated polyacrylamide; polyvinylamine; N-vinyl formamide; copolymer of acrylamide and diallyldimethylammonium chloride (DADMAC); polyamidoamine epihalohydrin and any of their mixtures.

13. The method according to claim 11 wherein the cationic synthetic copolymer is a copolymer originating from >20 mol-% of non-ionic monomers and 3-30 mol-%, 5-20 mol-% or 6-10 mol-%, of cationic monomers.

14. The method according to claim 11 wherein the cationic synthetic polymer has an average molecular weight of 600,000-950,000 g/mol.

15. The method according to claim 10, wherein the cationic agent has charge density of 0.05-5 meq/g, 0.1-3 meq/g, 0.3-2 meq/g or 0.5-1.4 meq/g, at a pH of 7.

16. The method according to claim 10, wherein the first strength composition is added to the fibre stock in amount of 0.2-15 kg/ton, 0.4-9 kg/ton produced paper or 1-5 kg/ton produced paper, calculated as dry product.

17. The method according to claim 10, wherein the second strength composition comprises 0.1-20 weight-%, 0.5-10 weight-% or 0.7-4 weight-% of anionic hydrophilic polymer, and 80-99.9 weight-%, 90-99 weight-% or 96-99 weight-% of starch.

18. The method according to claim 10, wherein the anionic monomer is selected from unsaturated mono- or dicarboxylic acids.

19. The method according to claim 10, wherein the anionic hydrophilic polymer of the second strength agent has an average molecular weight of 350 000-950 000 g/mol.

20. The method according to claim 10, wherein the anionic hydrophilic polymer of the second strength agent originates from >20 mol-% of non-ionic monomers and 4-17 mol-%, of anionic monomers.

21. The method according to claim 10, wherein the fibre stock comprises at least 10-30% or 11-19% of inorganic mineral filler, measured by ash content at 525° C.

22. The method according to claim 10, wherein the fibre stock comprises at least 20 weight-% or at least 50 weight-%, of fibres originating from recycled paper or board.

23. The method according to claim 10, wherein the second strength composition is applied on the fibre web in such amount that the anionic hydrophilic polymer is applied on the web in an amount of 0.1-5 kg/t, 0.2-3 kg/t or 0.5-2 kg/t.

* * * * *